US005263618A

United States Patent [19]

Talavera

[11] Patent Number: 5,263,618

[45] Date of Patent: Nov. 23, 1993

[54] UNIVERSAL CARRIER FOR ARTICLES

[76] Inventor: Victor Talavera, 12122 Otsego St., North Hollywood, Calif. 91607

[21] Appl. No.: 827,704

[22] Filed: Jan. 27, 1992

[51] Int. Cl.[5] ..... A45F 5/00

[52] U.S. Cl. ..... 224/148; 224/192; 224/206; 224/209; 224/214; 224/901; 224/151

[58] Field of Search ..... 224/209, 206, 204, 148, 224/192, 214, 250, 901, 151

[56] References Cited

U.S. PATENT DOCUMENTS

| | | | |
|---|---|---|---|
| 1,383,315 | 7/1921 | Lethern | 224/214 |
| 1,610,805 | 12/1926 | Monro | 224/206 |
| 1,884,328 | 10/1932 | Sperling | 224/206 |
| 2,372,971 | 4/1945 | Moore | 224/206 |
| 3,252,638 | 5/1966 | Rolston et al. | 224/192 |
| 4,796,790 | 1/1989 | Hamilton | 224/253 |
| 4,953,765 | 9/1990 | Little et al. | 224/151 |

FOREIGN PATENT DOCUMENTS

| | | | |
|---|---|---|---|
| 2182552 | 5/1987 | United Kingdom | 206/316.2 |

*Primary Examiner*—Linda J. Sholl
*Attorney, Agent, or Firm*—Julius Rubinstein

[57] ABSTRACT

A universal carrier comprises a pocket holding support and a harness for attachment to the body of a person carrying objects on the support. The support has an outwardly facing surface whereon various sized article holding pockets can be secured. A strap like extension extends from the support and is attached to a vertical strap on the harness. Article holding pockets are secured to the outwardly facing surface on the support, and at least one water bottle carrying pocket is secured to the vertical strap on the harness. The water bottle is attached at a proper level and has a flexible tube extending out from its mouth enabling a person engaged in an activity requiring the use of both hands to move his head so the end of the tube can enter his mouth permitting the person to get a drink without using his hands.

3 Claims, 2 Drawing Sheets

FIG. 1.
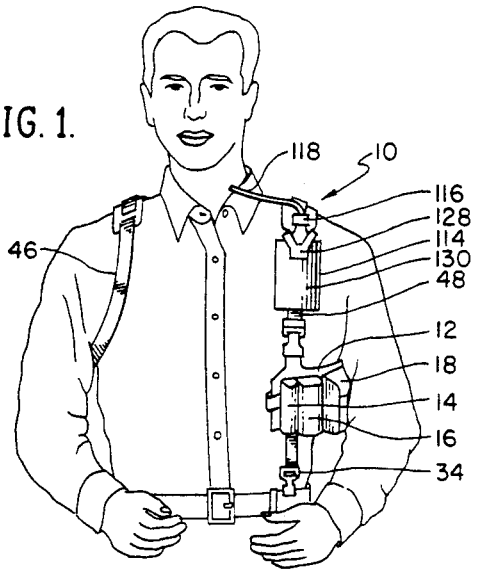
FIG. 2.
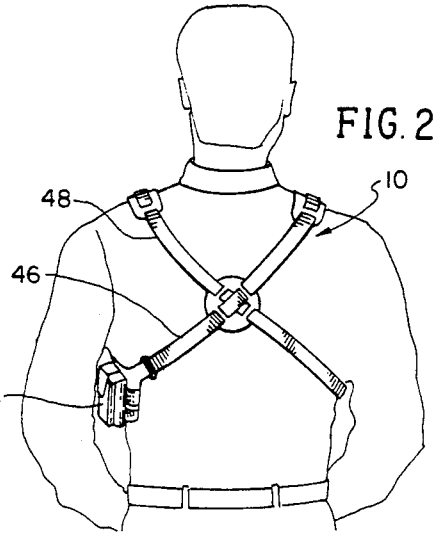
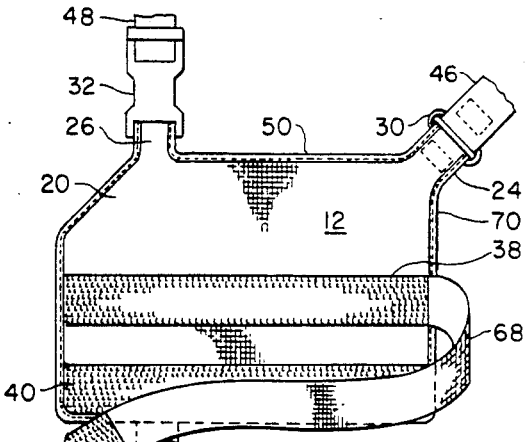
FIG. 3.
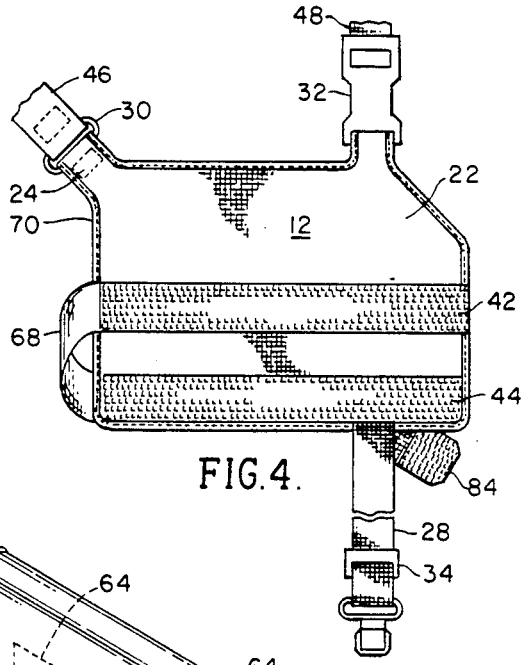
FIG. 4.
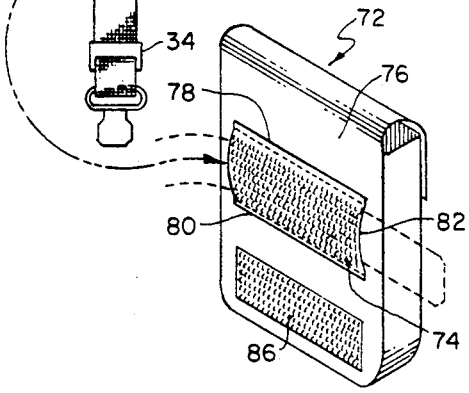
FIG. 5.
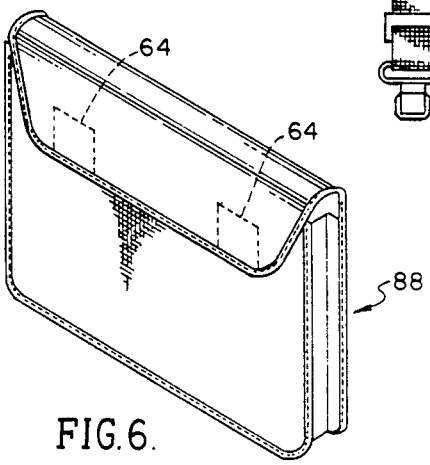
FIG. 6.

FIG. 7.
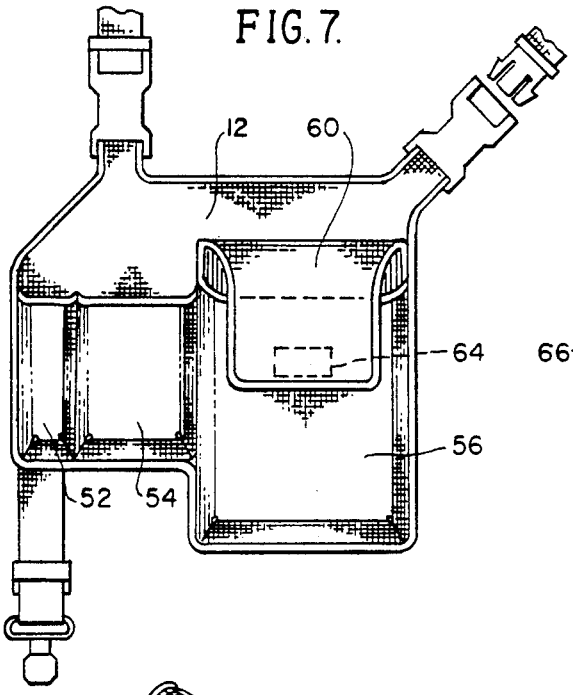
FIG. 8.
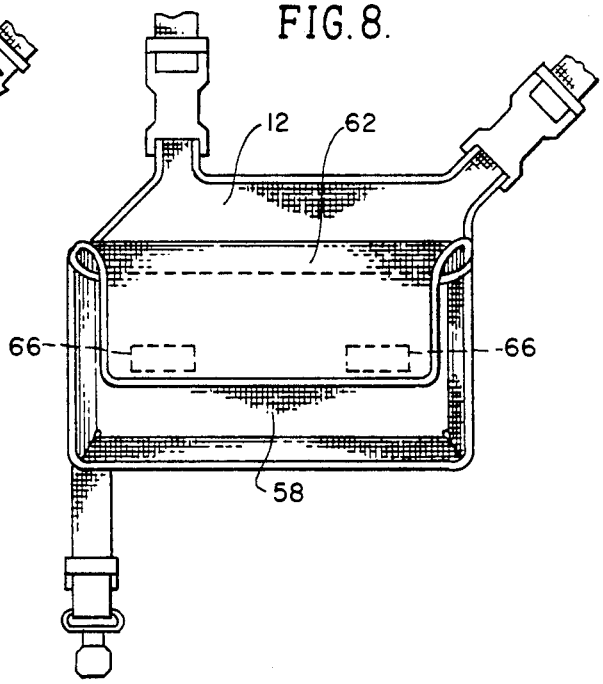
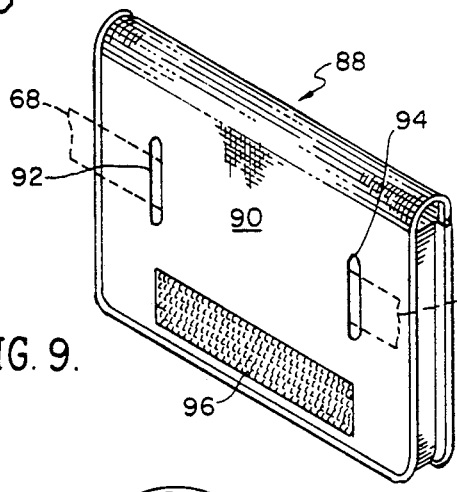
FIG. 9.
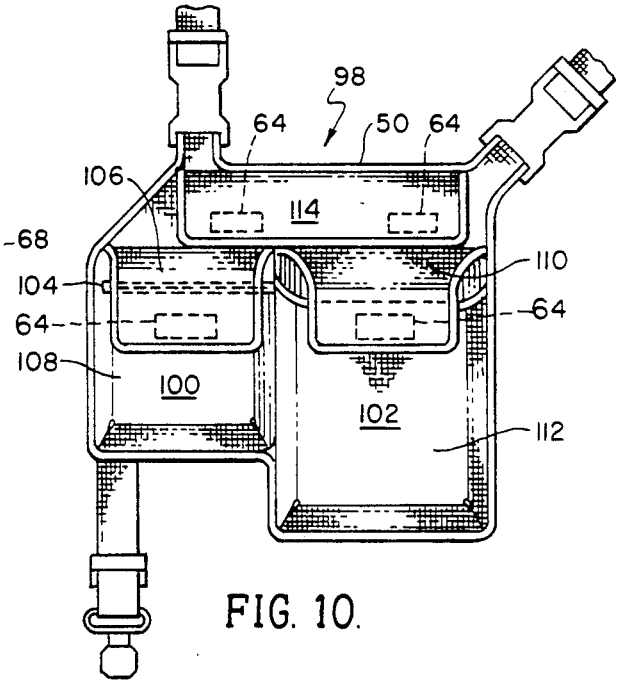
FIG. 10.
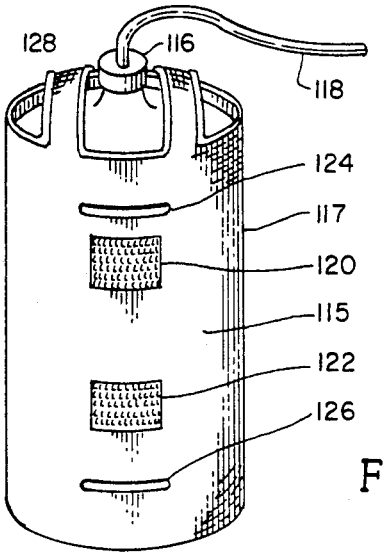
FIG. 11.

UNIVERSAL CARRIER FOR ARTICLES

This invention relates generally to a universal carrier for carrying articles on the body of a person.

BACKGROUND AND BRIEF SUMMARY

People at various times carry a virtually unlimited number of articles with them. These articles are often carried in pouches or purses attached to straps suspended over the shoulders of persons carrying them, as shown in U.S. Pat. No. 3,379,961 by Soukeras or U.S. Pat. No. 1,884,328 by Sperling.

These purses or pockets were not designed so that a number of differently shaped articles could be carried at the same time and in easily accessible seperate pockets. However there is a need for such a device in certain circumstances.

For example, a physician visiting a patient might find it helpful to carry various medicines in special pockets attached to his body where the pockets are sized to snugly receive the containers holding the medicine. This would be of value if the physician were traveling by air because the medicine would be insulated from aircraft vibration by the resilience of the body of the physician. Since doctors visit a variety of patients, who require different medicines, it would be useful if pockets, each shaped to hold a container of medicine having a similar size could be removably attached to the body of the physician. In this way, if the patient was at a place which required substantial activity to be reached, the containers of medicine, snugly held in pockets mounted on the support and attached by the harness to the body of the physician, would be prevented from falling out of the pockets and becoming lost. Another advantage in having the pockets sized to snugly hold the containers of medicine would be in a situation where the physician had to administer medicine in the dark as during a power failure. In this situation the physician could identify the medicine in the container by feel of the pocket and there would be no chance that he could administer the wrong medicine or put the medicine back in the wrong pocket.

In addition, a person climbing a tall antenna or telephone pole, might wish to have a drink while he is using both hands for climbing, would find it convenient to be able to drink something without removing his hands. Or the person might wish to have something to eat or smoke while he is up the antenna or pole, and could find it awkward to have to fumble around in his pockets to search for a sandwich or find a package of cigarettes and a lighter. In that situation, the person might find it useful to have a carrier and harness which has seperate pockets or receptacles properly sized and conveniently positioned to provide access to what he needs.

What is needed, therefore, and comprises an important object of this invention is to provide universal support and harness adapted to removably hold various pockets, each sized to hold a similarly sized container or object.

This and other objects of this invention will become more apparent when better understood in the light of the accompanying drawings and specification wherein:

FIG. 1 is a front view of a person wearing the pocket support and harness.

FIG. 2 is rear view of the person wearing the harness shown in FIG. 1.

FIG. 3 is a front elevational view of the universal support to which the harness is attached.

FIG. 4 is a rear elevational view of the universal support shown in FIG. 3.

FIG. 5 is a perspective view of a pocket adapted to be mounted on the universal support.

FIG. 6 a perspective view of a purse which can be mounted on the universal support.

FIG. 7 is a front elevational view of a support with various sized pockets attached thereto.

FIG. 8 is a front elevational view of a purse-like pocket mounted on the universal support shown in FIGS. 3 and 7.

FIG. 9 is a rear perspective view of a modified purse-like pocket showing the way the pocket is attached to the support shown in FIGS. 3 and 4.

FIG. 10 shows an alternate embodiement of the universal support shown including a receptacle for glasses.

FIG. 11 discloses a rear view of a carrier containing a water bottle adapted to be attached to a strap of the harness secured to the body of a person.

Referring now to FIG. 1 of the drawing, there is shown a front view of a person wearing a harness 10 attached to a universal support 12. A plurality of pockets 14,16, and 18 are permanently or removably attached to the support 12.

The support 12 is formed from a thin flexible material, in this case cloth, and has identical opposite surfaces 20 and 22, see FIGS. 3 and 4. In addition, the support 12 has narrow strap like extensions 24, 26, and 28 which are attached to buckles 30, 32 and 34 which are designed to be connected to the harness 10 or belt 36, see, FIG. 1. Velcro is a material used to attach pieces of fabric together. Velcro, and material like it, comprise two pieces of material known as a hook and pile, which stick together when the hook material is pressed against the pile material. As will be described below Velcro is used here to stick various pieces of material together. Here two parallel strips 38 and 40 of Velcro pile are attached to surface 20 and extend horizontally from side to side of the support 12. The opposite surface 22 of the support 12 also has two spaced parallel strips 42 and 44 of Velcro pile extending horizontally from side to side, see FIGS. 3 and 4.

As shown in FIGS. 3 and 4, the narrow strip-like extension 24 of the support 12 attached to buckle 30 and to harness strap 46 and the narrow strip-like extension 26 attached to buckle 32 is attached to harness strap 48, see FIGS. 1,2,3, and 4.

It is noted in FIGS. 3 and 4 that the narrow extension 24 is inclined to the top edge 50 of the support 12 while the narrow extension 26 extends perpendicularly upward from the top edge 50. With this arrangement, the extension 24 can be conveniently attached to strap 46 of the harness passing under one of the arms of the wearer of the harness, see FIGS. 1 and 2. While the perpendicular extension 26 attached to strap 48 of the harness, extends upward at the opposite side of the support 12 over the shoulder of the person wearing the support and harness.

The inclination of extension 24 is important because both surfaces of the support 12 are identical. Consequently depending on the preference of the wearer, by simply reversing the support 12 so that surface 22, shown in FIG. 4 faces outwardly, the inclined extension 24 will be attached to strap 46 passing under the opposite arm of the wearer. This could be important depending on whether the wearer is right handed or left handed.

The support 12 is designed to permanently or releasably hold one or more pockets, purses, or container holders as exemplified by the pockets 52, 54, 56 and 58 shown in FIGS. 7 and 8. The pockets 52, and 54 in this instance are open at the top and may be sized to hold a cigarette lighter and a package of cigarettes, while pocket 56 has a locking flap 60 designed to retain, for example, a telephone or a pager. Similarly the larger purse-like pocket 58, shown in FIG. 8, has a locking flap 62 for holding the contents securely inside. The flaps 60 and 62 have Velcro strips, 64 indicated by the dotted rectangles, sewn or secured to the inner surface of the flaps. These strips engage the opposite portion 66 of the Velcro (not shown) which are secured to the surface of the pocket engaged by the Velcro strip 64 so that the flaps are held against the surface of the pockets thereby locking the contents inside the pocket.

In an embodiment where the pockets are designed to be removable, a strap 68 is secured to the edge 70 of the support see FIGS. 3 and 4. This strap is attached to the edge of the support by the Velcro pile strips 38 and 42, see FIGS. 3 and 4.

One embodiment of a removable pocket 72 is shown in FIG. 5. In this embodiment a strip 74 of the hook portion of Velcro is attached to the rear surface 76 of pocket 72. The upper and lower edges 78 and 80 of strip 74 are secured by sewing or any other suitable means to the rear surface 76 of pocket 72. The strip 74 is wider than the space between the upper and lower edges of the strip 74 where they are secured to the rear surface 76 of the pocket 72, defining thereby a strap receiving tunnel 82.

A strip 84 of Velcro hook is attached to the end of the strap 68, see FIG. 3. The strap 68 is inserted through the tunnel formed on the rear surface 76 of the pocket 72. Then the hook portion of the Velcro strip 74 on the rear surface 76 of the removable pocket 72 is pressed against the strip of Velcro pile 38 on surface 20 or 22 of the support 12 and is attached thereto by the engagement of the hook and pile of the Velcro. The end of the strap 76 containing the strip of Velcro hook 84 is wrapped around the opposite surface of the support and the hook end 84 is pressed against the pile portion of the Velcro strip thereby securely holding the pocket to the support.

For greater holding strength an additional strip 86 of the hook portion of Velcro is secured near the bottom of the rear surface 76 of the pocket 72. In this way when the rear surface 76 of pocket 72 is pressed against either surface 20 or 22 of the support 12, the hook portion of Velcro adheres to the pile portion 40 or 44, depending on which surface of the support is facing outwardly, so that the rear surface 76 of the pocket 72 is attached to the support in two places.

A modified purse-like pocket 88 designed to be attached to a surface of the support 12 is shown in FIG. 6. The rear surface 90 of the pocket 88 is shown in FIG. 9. There it is seen that spaced parallel slits 92 and 94 are cut into surface 90. These slits are long enough so that strap 68 can be inserted into slit 92 and emerge, as shown from slit 94, thereby attaching the pocket 88 to a surface 20 or 22 of the support. As stated above, when the strap 68 has entered and exited the slits, the strip is wrapped around the support 12 and the hook portion 84 of the strap is pressed against the Velcro pile strip on the opposite surface of the support 12, thereby securely holding the pocket 88 to the support.

To further strengthen the connection between the pocket 88 and the support 12, an additional strip of Velcro hook 96 is secured by any suitable means near the bottom of the rear surface 90 of the pocket. In this way when the strap 68 has been threaded through the slits 92 and 94, and the rear surface 90 of the pocket 88 has been pressed against a surface of the support 12, the pocket 88 will be securely held against the support 12 by the strength of strap 68 and the engagement of the Velcro hook strip 96 with the Velcro pile strip 40 or 44, depending on which surface of the support faces outwardly.

Another modification of the invention is shown in the support 98 shown in FIG. 10. In this embodiment the pockets 100 and 102 are secured to carrier 98, either permanently or removably by the attaching means described in connection with the embodiments shown in FIGS. 3 to 6. In this modification, pocket 100 is designed to hold coins, and it includes a zipper 104 designed to lock the coins in pocket and a flap 106 designed to conceal or protect the zipper. Flap 106 is held to the front surface 108 of the pocket by patches 64 of Velcro in the manner shown in FIG. 7.

Pocket 102 is wider than pocket 100 and may be used to carry a wallet. The entrance to the pocket 102 is covered by a flap 110 which is attached to the front surface 112 of the pocket by Velcro patches 64, as described above.

An elongated flap 114 is attached to the top edge 50 of the support. This flap has a number of functions. It could be used to hold elongated instruments to the support, such as pens and pencils, and the like, or the side templets of eye glass frames, so that eye glasses can be secured to the support. In addition, the front of the flap could be used for advertising purposes. The flap may be attached to the outwardly facing surface of the carrier 98 by Velcro strips as described above to prevent the articles held beneath the flap from falling off.

Referring to FIG. 11, a water bottle cover 117 is formed from an insulating material. The rear surface 115 of water bottle cover 114 is provided with vertically spaced horizontally extending strap 114 is provided with vertically spaced horizontally extending strap receiving slits 124 and 126. In addition small patches 120 and 122 of vertically spaced Velcro hook are also secured to the rear surface 115 of the water bottle cover 117 as shown.

Similarly, correspondingly positioned patches of Velcro pile (not shown) are secured in vertically spaced relationship to the strap 48 of the harness 10. As seen in FIG. 1, the vertical strap 48 extends into slit 124 and out slit 126 on the rear surface 115 of the water bottle cover, attaching the cover 117 to the strap 48.

Another way the vertical strap 48 could be attached to the water bottle cover 117 is to shape the Velcro hook on patches 120 and 122 in the manner shown in FIG. 5 defining tunnels through which the vertical strap can extend. This would eliminate the need for the slits 124 and 126.

In circumstances where it is desirable to be able to quickly attach or remove the water bottle cover 117 holding the water bottle 116 from strap 48, without removing the harness 10 from the body of the person wearing it, the Velcro pile on the rear surface 115 of the cover 117 can be pressed against the Velcro hook on strap 48 of the harness, causing the cover 117 to stick to the strap 48.

The advantage of attaching the water bottle to the harness strap, is that it permits a person wearing the harness with the attached water bottle, and using both hands to climb, or carry something, to move his head in order to get the end of the straw 118 in his mouth to suck up the contents of the bottle 116. cover 117, a flap 128 shown in FIGS. 1 and 11 extends from the rear surface 115 of the water bottle cover 117 over the top of the bottle to the front surface 130 of the cover 117 where it is attached to the front surface by Velcro patches, in the manner described above.

Having described the invention, what I claim as new is:

1. A universal carrier comprising in combination a support and a harness, said support formed from a thin flexible material having outwardly and inwardly facing surfaces and an upper edge, first and second extensions extending from the said upper edge of said support and adapted to be attached to said harness, said harness including at least one upwardly extending strap for attachment to the body of a person carrying objects on the support, the first extension extending upwardly and transverse to the said upper edge of said support for attachment to said upwardly extending strap on said harness, at least one pocket comprising a water bottle cover, said water bottle cover having a front surface and a rear surface, said rear surface provided with vertically spaced horizontal strips whereby the upwardly extending strap on said harness can enter one horizontal slit and exit the other horizontal slit so that the water bottle cover is removably and adjustably secured to said upwardly extending strap on said harness for movement up and down the strap, at least another pocket secured to the outwardly facing surface on said support with the opposite surface of said support bearing against the body of the person wearing said support, said support having an upper edge, said first and second extensions extending from the said upper edge of said support for attachment to harness support straps, at least one of said extensions extending from said upper edge of said support at an inclined angle to said upper edge for attachment to a harness strap extending toward one arm of a person wearing the support and adapted to pass under the arm of a person wearing the harness strap and support, each pocket on said support having an inner surface and an outer surface, securing means for removably securing each pocket to either of the surfaces of said support, at least one pocket positioned on said support adjacent said inclined extension and in a position where it is at least partially concealed under the arm of a person carrying the support, said support reversible so the surface initially bearing against the body of the person wearing the support can face outwardly whereby said inclined extension extends toward the opposite arm of the wearer of the harness and support so that it can be attached to a strap extending under the opposite arm of a person wearing the support, so that access to said one pocket mounted on said support under opposite arm of a person carrying the support, is equally convenient to right and left handed persons, said securing means comprising a pile material and a hook material which stick together when they are pressed against each other for removably securing said pocket to either of said surfaces of said support, two spaced parallel strips of said pile material extending horizontally across each surface of said support and two similarly spaced strips of hook material secured to the rear surface of each pocket to hold the pocket to the outwardly facing surface of said support. said support having a side edge, at least one strip of hook material with upper and lower edges secured to the rear surface of each pocket, said strip of hook material wider than the space where the edges of the hook material are secured to the rear surface of each pocket defining thereby a strap receiving tunnel, a strap secured to said side edge of the support, said strap having an end portion formed from a hook material and long enough to extend through said tunnel with its end portion engaging the pile portion on a surface of said support, whereby when the rear surface of said pocket is pressed against the outwardly facing surface of the support, the engagement of the hook material on the strip secured to the rear surface of said pocket and the pile material strip on the outwardly facing surface of the support causes the pocket to stick to the support, and the engagement of the hook material on the edge of the strap extending through said tunnel with the pile material on one of the surfaces of the support strengthens the attachment of said pocket to said support.

2. A universal carrier comprising in combination a support and a harness, said support formed from a thin flexible material having outwardly and inwardly facing surfaces and an upper edge, first and second extensions extending from the said upper edge of said support and adapted to be attached to said harness, said harness including at least one upwardly extending strap for attachment to the body of a person carrying objects on the support, the first extension extending upwardly and transverse to the said upper edge of said support for attachment to said upwardly extending strap on said harness, at least one pocket comprising a water bottle cover, said water bottle cover having a front surface and a rear surface, said rear surface provided with vertically spaced horizontal strips whereby the upwardly extending strap on said harness can enter one horizontal slit and exit the other horizontal slit so that the water bottle cover is removably and adjustably secured to said upwardly extending strap on said harness for movement up and down the strap, at least another pocket secured to the outwardly facing surface on said support with the opposite surface of said support bearing against the body of the person wearing said support, said support having an upper edge, said first and second extensions extending from the said upper edge of said support for attachment to harness support straps, at least one of said extensions extending from said upper edge of said support at an inclined angle to said upper edge for attachment to a harness strap extending toward one arm of a person wearing the support and adapted to pass under the arm of a person wearing the harness strap and support, each pocket on said support having an inner surface and an outer surface, securing means for removably securing each pocket to either of the surfaces of said support, at least one pocket positioned on said support adjacent said inclined extension and in a position where it is at least partially concealed under the arm of the person carrying the support, said supper reversible so the surface initially bearing against the body of the person wearing the support can face outwardly whereby said inclined extension extends toward the opposite arm of the wearer of the harness and support so that it can be attached to a strap extending under the opposite arm of a person wearing the support, so that access to said one pocket mounted on said support under opposite arm of a person carrying the support, is equally convenient to right and left handed persons, said securing means comprising a pile material and a hook material which stick together when they are pressed against each other for removably securing said pocket to either of said surfaces of said support, tow spaced parallel strips of said pile material extending horizontally across each surface of said support and two similarly spaced strips of hook material secured to the read surface of each pocket to hold the pocket to the outwardly facing surface of said support, said support having a side edge, said means for removably securing each pocket to a surface of said support including a strap secured to said side edge of said support, said rear surface of said pocket having spaced parallel elongated strap receiving vertical slits formed thereon, said strap long enough to enter one of the slits in the rear surface of said pocket and to exit the pocket through other slit for attachment to said support to hold said pocket on said support.

3. The universal carrier described in claim 2 wherein one end of said strap is formed from a hook material, the hook material of said strap adapted to engage a pile strip on an opposite surface of said support to securely hold said pocket to said support.

* * * * *